US008910896B2

(12) United States Patent
Koskol

(10) Patent No.: US 8,910,896 B2
(45) Date of Patent: Dec. 16, 2014

(54) PRECISION WIND SYNTHETIC ELASTOMERIC FIBER AND METHOD FOR SAME

(75) Inventor: Joseph E. Koskol, Wilmington, DE (US)

(73) Assignee: INVISTA North America S. à r. l., Wilmington, DE (US)

( * ) Notice: Subject to any disclaimer, the term of this patent is extended or adjusted under 35 U.S.C. 154(b) by 651 days.

(21) Appl. No.: 13/125,400

(22) PCT Filed: Oct. 23, 2009

(86) PCT No.: PCT/US2009/061871

§ 371 (c)(1),
(2), (4) Date: Apr. 21, 2011

(87) PCT Pub. No.: WO2010/062530

PCT Pub. Date: Jun. 3, 2010

(65) Prior Publication Data

US 2011/0203964 A1 Aug. 25, 2011

Related U.S. Application Data

(60) Provisional application No. 61/108,633, filed on Oct. 27, 2008.

(51) Int. Cl.
*B65H 54/38* (2006.01)

(52) U.S. Cl.
USPC ..... 242/477.6; 242/178

(58) Field of Classification Search
CPC .... B65H 54/38; B65H 54/381; B65H 54/383; B65H 55/04; B65H 2701/319
USPC ..... 242/174, 176, 178, 477.6
See application file for complete search history.

(56) References Cited

U.S. PATENT DOCUMENTS 3,241,779 A * 3/1966 Bray et al. ..... 242/477.6
5,560,558 A 10/1996 Wray (Continued)

FOREIGN PATENT DOCUMENTS

CN 1355763 A 6/2002
DE 19927916 A1 12/2000

(Continued)

OTHER PUBLICATIONS

European communication dated Jul. 19, 2013 for a counter part foreign application.

(Continued)

*Primary Examiner* — William E Dondero
(74) *Attorney, Agent, or Firm* — Christina W. Geerlof

(57) ABSTRACT

A method of winding an elastomeric yarn, such as spandex, onto a spool includes the steps of providing a spool; providing an elastomeric yarn; rotating the spool at a speed to define a spool rotation speed; moving the yarn traversely with respect to the spool in an alternating to and fro manner to define a traverse frequency; winding the yarn onto the spool; controlling the ratio of the spool rotation speed to the traverse frequency to define a wind ratio during the winding of the yarn onto the spool; and decreasing the traverse speed as the yarn is wound onto the spool in an inverse proportion to an amount of yarn that has been wound. The winding of the yarn onto the spool forms a yarn cake on the spool. The traverse speed may be decreased in inverse proportion to a diameter of the yarn cake. The method may further include the step of shifting the yarn by a pitch for each rotation of the spool.

2 Claims, 4 Drawing Sheets

(56) References Cited

U.S. PATENT DOCUMENTS

| | | | |
|---|---|---|---|
| 6,844,039 | B1 | 1/2005 | Kausch et al. |
| 2007/0120286 | A1 | 5/2007 | Van der Hoorn |

FOREIGN PATENT DOCUMENTS

| | | | |
|---|---|---|---|
| JP | 06-025262 | | 4/1994 |
| JP | H6-25262 | U | 4/1994 |
| JP | H7-89671 | A | 4/1995 |
| JP | 2002274751 | A | 9/2002 |
| JP | 2003-502523 | A | 1/2003 |
| JP | 2006248758 | A | 9/2006 |
| JP | 2007-533571 | | 11/2007 |
| JP | 2008-19061 | A | 1/2008 |

OTHER PUBLICATIONS

English translation of DE 19927916 A1.
English Translation of CN 1355763.
English Translation of JP 2003-502523.
English Translation of JP 2008-19061.
English Translation of JP H6-25262.
English Translation of JP H7-89671.
English Machine Translation of JP 2002-274751.
English Machine Translation of JP 2006-248758.

* cited by examiner

FIG. 8
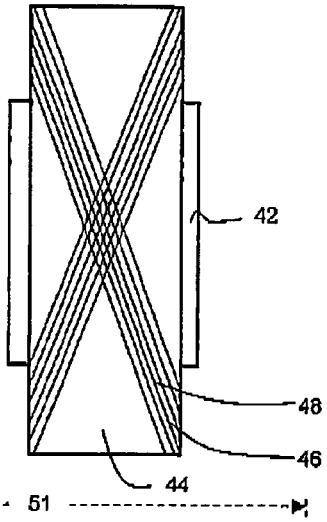
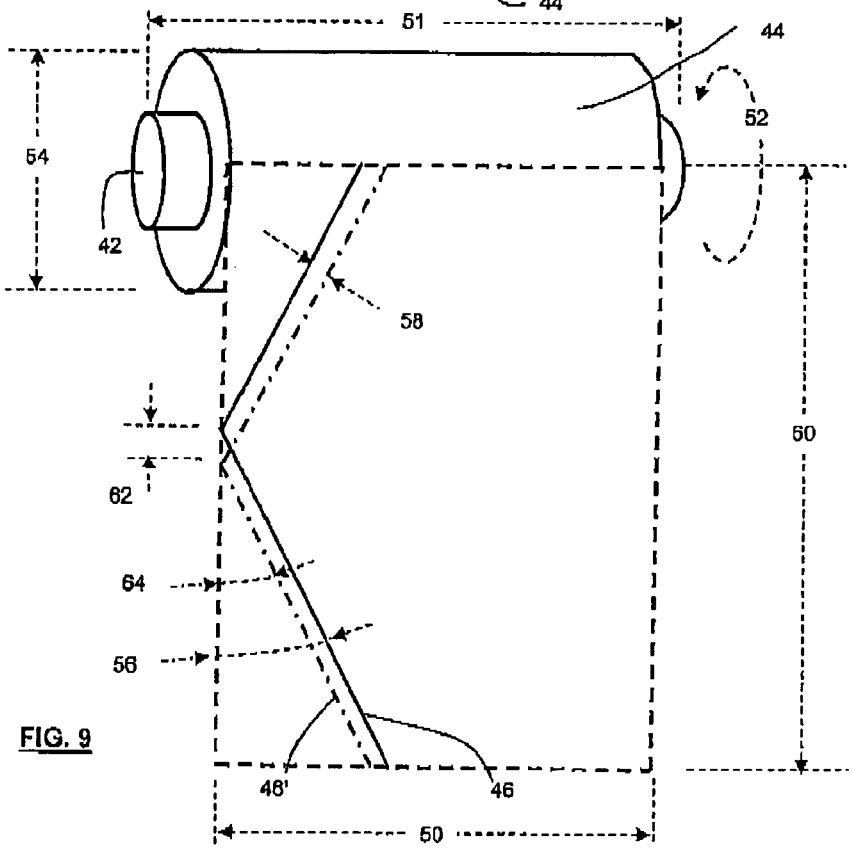
FIG. 9

PRECISION WIND SYNTHETIC ELASTOMERIC FIBER AND METHOD FOR SAME

CROSS-REFERENCE TO RELATED APPLICATION

This application claims benefit of priority from U.S. Provisional Application No. 61/108633 filed Oct. 27, 2008.

BACKGROUND OF THE INVENTION

1. Field of the Invention

This invention relates to package of wound elastomeric fiber and a method for the same. In particular, the invention relates to precision wound spandex.

2. Description of Related Art

In winding a yarn or multi-filament fiber onto a package, the package is typically rotated and the yarn is fed to the circumferential surface of the package and distributed axially along the package by a traverse arrangement, such as a reciprocating fiber guide. In random winding, the package is rotated, typically, by frictional contact with a drive roller acting directly on the surface of the package, or by directly powering the chuck holding the packages which are in contact with a non-driven roller. The package has typically the same surface speed as the roller and is typically kept constant during winding. As the surface speed is constant, a declining rotational speed of the package occurs as the package increases in diameter, while the traversing apparatus reciprocates the fiber at a nominally constant frequency. As a result, the yarn lay is random, giving the term of "random winding" to this technique. One problem of random winding is that as the package grows to certain diameters successive turns of yarn (or every other or every third or fourth turn of yarn) may lie one on top of one and the other, giving rise to ribbons of yarns which tend to not only distort the package shape, but may also adversely affect subsequent unwinding of the yarn from the package. These ribbons also cause undesirable vibrations in winding and unwinding which can result in fiber disturbances, such as tangles and breaks.

Surface winding of an elastomeric yarn, such as spandex, is a difficult process because of the very low tension developed in the fiber due to its highly elastomeric properties and to its very sticky nature. To develop enough tension to process the fiber in spinning, a significant amount of stretch is required. Due to the high stretch required, the wound yarn cake will be under high internal tension which may cause the core fibers of the wound cake to begin to fuse together. Furthermore, ribbons that may be formed during random winding represent regions of higher density, compared to other portions of the cake. With random winding of elastomeric yarns, such ribbons may lead toward the fusing of yarns within the yarn package.

Thus, there is a need in the art to improve winding techniques, especially for elastomeric yarns, to avoid problems associated with the prior art.

SUMMARY OF THE INVENTION

In precision winding, the ratio of the cyclic frequency of the traverse guide to the rotational speed of the package is constant. The ratio of the spindle rotation speed in revolutions per minute (rpm) to the transverse frequency in cycles per minute (cpm) is commonly referred to as a wind ratio. A package formed by precision winding offers advantages over a package built up by random winding, such as by avoiding ribbons, avoiding localized places of higher compression by uniformly distributing every yarn wrap, increasing cake/package density uniformity, and increasing the amount of yarn in a given package diameter, among others.

In one embodiment, a method of winding an elastomeric yarn onto a spool is provided. The method includes providing a spool; providing an elastomeric yarn; rotating the spool at a speed to define a spool rotation speed; moving the yarn traversely with respect to the spool in an alternating to and fro manner to define a traverse frequency; winding the yarn onto the spool; controlling the ratio of the spool rotation speed to the traverse frequency to define a wind ratio during the winding of the yarn onto the spool; and decreasing the traverse speed as the yarn is wound onto the spool in proportion to the decreasing rotational speed of the package. The winding of the yarn onto the spool forms a yarn cake on the spool. The traverse speed may be decreased in inverse proportion to a diameter of the yarn cake. The method further includes shifting the yarn by a pitch between successive laydown patterns. If there is no yarn shift, ribbons would be the expected result.

The method further includes controlling the wind ratio, where the wind ratio may be controlled by the following, as employed in one particular winding machine:

$$W=(N+\epsilon)/J \quad \text{(formula 1)}$$

where:

W is the wind ratio,

J is the traverse base cycle in cycles per minute (cpm),

N is the spool rotation in revolutions per minute (rpm), and $\epsilon$ is the shift amount of the yarn in terms of rotation(°).

$$\epsilon=Dy/(\pi*D*\sin\theta) \quad \text{(formula 2)}$$

where:

Dy is the pitch of the yarn in millimeters (mm),

D is the package diameter in millimeters (mm), and $\theta$ is the helix angle(°).

$$W=2*St/(\pi*D*\tan\theta) \quad \text{(formula 3)}$$

where:

St is the traverse stroke in millimeters (mm), and

D and $\theta$ are as defined above.

The pitch of the yarn can be selected by those of skill in the art including from about 0.1 mm to about 0.4 mm for 20 denier to 100 denier spandex and can be other ranges for other fibers. The optimum pitch is determined by testing and is highly dependent on yarn denier and flatness of the bundle in the wound package, with smaller pitch desirable for lighter denier fibers and larger pitch desirable for heavier denier fibers.

Further, the yarn may be wound at a helix angle $\theta$ over the spool, where the helix angle $\theta$ is an angle defined between a longitudinal extent of the spool and the yarn being wound onto the spool. The method may further include decreasing the helix angle $\theta$ during the winding of the yarn onto the spool. However, during part or all of the winding process, the wind ratio may be controlled to a substantially fixed value during winding. Further, during part or all of the winding process the wind ratio may be controlled in steps to limit the reduction in helix angle as the package rotational speed and traverse cyclic frequency reduce.

In a further aspect, the method may further include decreasing the rotation speed of the spool while keeping the traverse speed nominally constant forming a random wind. The step of decreasing the rotation speed of the spool while keeping the traverse speed constant may be done for an initial amount of the yarn being wound onto the spool to avoid exceptionally high helix angles otherwise required for precision wind of the initial small diameter windings of the cake. This initial amount of the yarn may be typically around 10 percent by weight of the total amount of yarn to be wound onto the spool, but can be more or less.

The precision wind process as described herein is advantageously applied to elastomeric yarn such as a segmented polyurethane yarn, in particular, a spandex yarn (also referred to as elastane).

In some embodiments are yarn cakes including precision wound spandex yarn having denier from about 20 to about 100. For a denier range including from about 40 to about 80, the yarn cakes may have an outside diameter of about 170 mm to about 190 mm and a weight of about 735 g to about 800 g, (including from about 745 g to about 760 g and about 750 g), including a yarn cake with precision wound spandex yarn of 40 denier having a weight of about 740 g to about 760 g and an outside diameter of about 175 mm to about 180 mm. Also included is an article having a box including about 36 precision wound 40 denier spandex cakes and about 26.8 Kg to about 27.4 Kg of yarn on the cakes. Variations of this packaging depending on the denier of the yarn are also included. For example, a 20 denier yarn may be formed into packages having a weight of about 440 g to about 460 g (including 450 g).

In another aspect is a method of increasing an amount of elastomeric yarn wound onto a spool is provided. The method includes providing a spool; providing an elastomeric yarn; rotating the spool at a speed to define a spool rotation speed; moving the yarn traversely with respect to the spool in an alternating to and fro manner to define a traverse frequency; winding the yarn onto the spool at a helix angle θ over the spool to form a yarn cake thereon, where the helix angle θ is an angle defined between a circumferential extent of the spool and the yarn being wound onto the spool; controlling the ratio of the spool rotation speed to the traverse frequency to define a wind ratio during the winding of the yarn onto the spool; and decreasing the traverse speed as the yarn is wound onto the spool in proportion to the rotational speed of the wound spool; where the yarn cake has at least about 3%, or preferably at least about 5% more yarn than a convention yarn cake of similar outside diameter (OD) formed by a conventional random winding process, where the random winding process includes the steps of providing the spool, providing the elastomeric yarn, and keeping the helix angle nominally constant by keeping the traverse speed fixed and decreasing the rotation speed.

These and other embodiments, objectives, aspects, features and advantages of this invention will become apparent from the following detailed description of illustrative embodiments thereof, which is to be read in connection with the accompanying drawings in which like reference characters refer to the same parts or elements throughout the different views. The drawings are not necessarily to scale, emphasis instead being placed upon illustrating the principles of the invention.

BRIEF DESCRIPTION OF THE DRAWINGS

FIG. 8 is an exploded front view of a package having a yarn wound onto a spool by precision winding according to the present invention.

FIG. 9 is a schematic depiction of a package having a yarn wound onto a spool by precision winding according to the present invention.

DETAILED DESCRIPTION OF THE INVENTION

Disclosed herein are winding techniques for elastomeric yarns, fibers or threads. As used herein, the terms yarn, fiber or thread are used interchangeably and refer to basic elongate textile units, such as extruded or dry-spun polymeric materials in filament form. As used herein an elastomeric yarn refers to the ability of the filaments to be stretched repetitively and still recover to substantially its original length, such as rubber. Elastomeric yarns can typically be stretched over about 500% without breaking. The elastomeric yarns may be spun from segmented polyurethanes. More specifically, the elastomeric yarns are directed to spandex yarns, also referred to as elastane.

The terms cake and package are used interchangeably and are meant to include a spool onto which spandex yarn has been wound. It is understood that a cake typically refers to a spool including yarn where the outside diameter (OD) is greater than the length; while a package typically refers to a spool including yarn having an OD less than the length. A spool also referred to as a tube core is a cylindrical article onto which yarn may be wound and may be made of any suitable material such as cardboard, wood, or metal, among others.

Examples of spandex yarns of varying type and denier are available under the brand names ELASPAN® and LYCRA®, which are commercially available from INVISTA S.ar.l., Wichita, Kans. Useful elastomeric yarns may vary in size from about 10 denier to about 200 denier, including from about 20 denier to about 140 denier. These denier ranges are non-limiting. Yarn denier represents the linear density of the yarn (weight in grams of 9,000 meters of length of the material). Thus, a yarn with a small denier would correspond to a very fine yarn whereas a yarn with a larger denier, e.g., 1000, would correspond to a heavy yarn.

Figure 1:
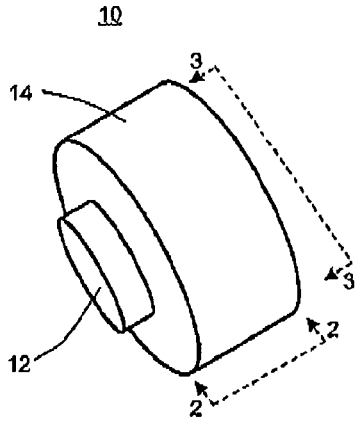
FIG. 1 is a perspective view of a package having a yarn wound onto a spool according to the present invention.
Figure 2:
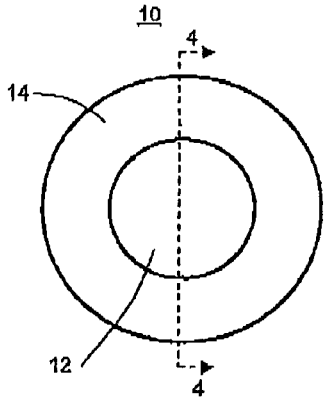
FIG. 2 is a side view of the package of FIG. 1 taken along the 3-3 axis.
Figure 3:
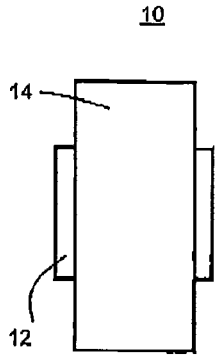
FIG. 3 is a front view of the package of FIG. 1 taken along the 2-2 axis.

FIG. 1 depicts a perspective view of a yarn package 10 according to some embodiments. The yarn package 10 includes a spool 12 having yarn (not shown) wound there over to provide what is commonly referred to in the industry as a yarn cake 14. As depicted in FIGS. 1-3, the yarn cake 14 represents a cylinder of wound yarn. For example, the yarn cake 14 is substantially circular as depicted in FIG. 2, which is a side view of the package 10 of FIG. 1 taken along the 2-2 axis. Further, the yarn cake 14 according to the present invention is substantially uniform from a front or top view as depicted in FIG. 3, which is a front view of the package 10 of FIG. 1 taken along the 3-3 axis.

Figure 4:
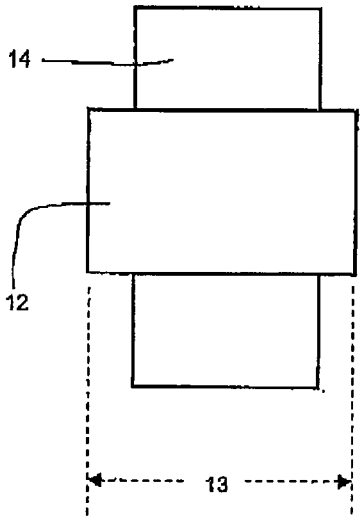
FIG. 4 is a cross-sectional view of the package of FIG. 1 taken along the 4-4 axis of FIG. 2.
Figure 5:
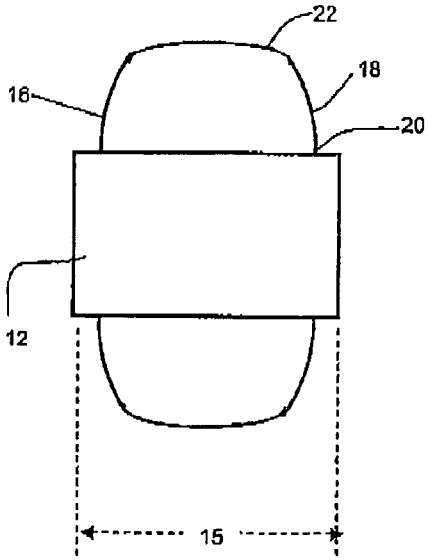
FIG. 5 is an alternate depiction of the cross-sectional view of the package of FIG. 4 according to the present invention.

FIG. 4 is a cross-sectional view of the package 10 taken along the 4-4 axis of FIG. 2. Again the yarn cake 14 is depicted as being a substantially cylindrical shape throughout the cross-section of the cake 14. In other words, the cake 14 is substantially cylindrical over the longitudinal extent 13 of the spool 12. The present invention, however, is not so limited to the substantially cylindrical yarn cake 14 as depicted in FIGS. 1-4. For example, as depicted in FIG. 5 the inventive yarn cake 16 may vary slightly from a true or substantially cylindrical shape over the longitudinal extent 15 of the spool 12. The sidewall 18 of the yarn cake 16 may have a slight contour where the base 20 of the yarn cake 16 may have a slightly greater transverse dimension than the top or surface 22 of the yarn cake 16. The contour of the sidewall 18 in FIG. 5 is exaggerated for the purpose of illustration. Moreover, the surface 22 of the wound yarn cake 16 is smooth in appearance, offering very high aesthetic appeal to the consumer. In fact, the surface 22 is so smooth that it appears to be machined from a block of plastic.

Figure 6:
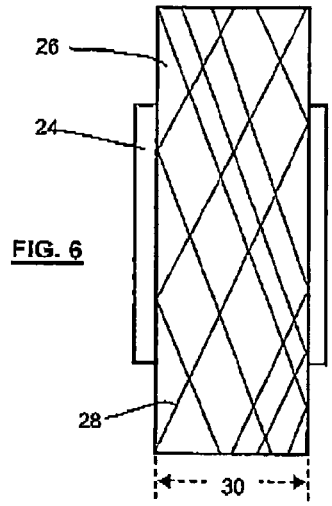
FIG. 6 is an exploded front view of a package having a yarn wound onto a spool by random winding according to the present invention.
Figure 7:
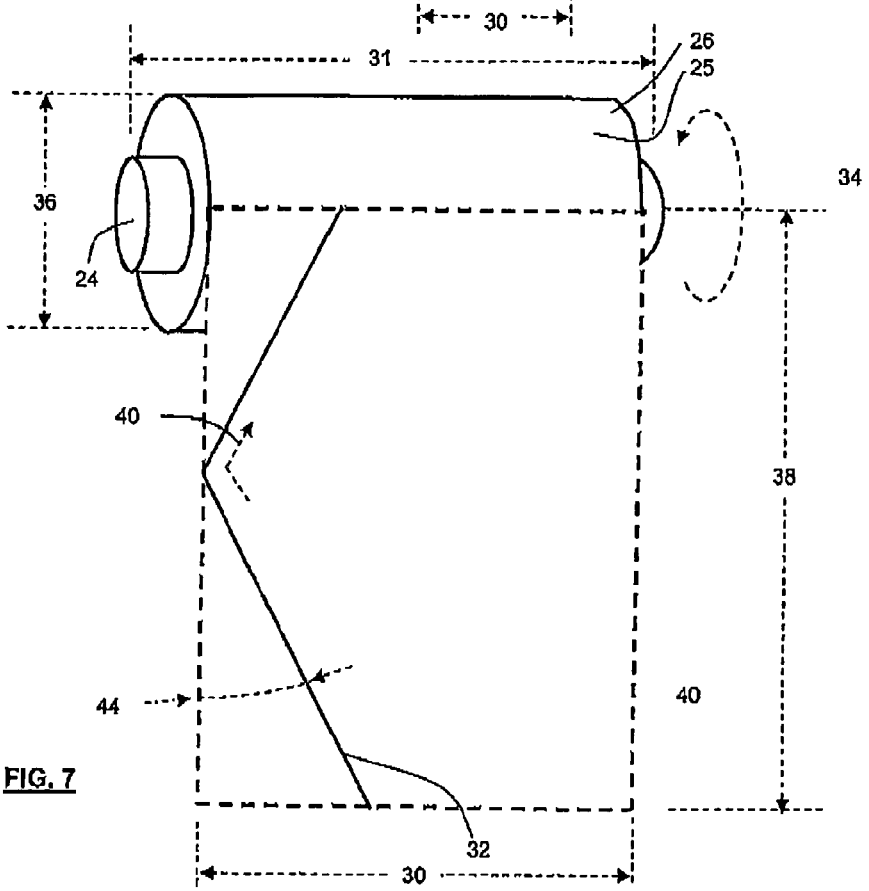
FIG. 7 is a schematic depiction of a package having a yarn wound onto a spool by random winding according to the present invention.

FIGS. 6 and 7 are schematic depictions of random winding, which may be used with some of the embodiments of the present invention. FIG. 6 represents a yarn cake 26 having an elastomeric yarn 28 wound onto a spool 24 by random winding. During random winding of the yarn 28, the spool 24 may be rotated as the yarn 28 is fed from the side of the cake 26. The yarn 28 is distributed axially along the cake 26 by a traverse arrangement (not shown), but indicated by vector 30. During random winding the helix angle θ, which is indicated by element number 32 in FIG. 7, is almost fixed as the transverse speed, as indicated by vector 34 of FIG. 7, may also be fixed. The helix angle θ is the angle at which the yarn 32 is wound with respect to the circumferential extent 31 of the spool 22. The spindle rotation speed 34 decreases in inverse proportion to the package or cake diameter 36. In random winding, the spool 24 and the cake 26 are rotated, typically, by frictional contact with a drive roller (not shown) acting directly on the surface 25 of the cake 26. The cake 26 has the same surface speed as the driver roller (not shown) and may kept constant, including substantially constant, during winding.

As depicted in FIG. 6, the yarn 28 is laid at random to form the cake 26. Such random laying of the yarn 28 is also depicted in FIG. 7 by vector 40, where vector 38 represents the surface 25 of cake 26 for one rotation, i.e., 360°, of the cake 26. If the ratio of the spindle rotation speed (N) to the traverse frequency (J) becomes an integer (where N and J are simple integers), an N:J ribbon may be formed. For example, if the spindle rotation speed 34 is 6,000 rpm and the traverse frequency 30 is 2,000 cpm, the (spindle rotation speed)/(traverse frequency)=6000/2,000=3:1, and the ribbon generated in this case is called a 3:1 ribbon. When a ribbon is generated, it not only causes yarn breakage during detwisting, it can also cause package defects like yarn dropping and package collapse, and machine vibration. As described below random winding of an elastomeric yarn may be combined with the inventive winding techniques discussed below to provide unexpected and improved results.

FIGS. 8 and 9 are schematic depictions of the precision winding method. In precision winding the speed of a traverse guide (not shown), but indicated by vector 50 in FIG. 9, is controlled with respect to the rotations speed 52 of the cake 44. The elastomeric yarn 46 is deposited sequentially next to one and the other in a precise offset 48 throughout the winding cycle to provide a precision wound cake 44 on spool 42. In precision winding or fixed wind ratio winding, the ratio of the spindle rotation speed (rpm) 52 to the traverse frequency (cpm) 50 is called the wind ratio. When the wind ratio is kept fixed from winding start to winding end, such a method is typically referred to as single precision winding or fixed wind ratio winding. When winding is performed at the same wind ratio from winding start to winding end, the traverse speed 50 decreases in inverse proportion to the package diameter 54, and the helix angle θ, which is indicated by element 56 and which is the angle at which yarn 46 is being wound with respect to the circumferential extent 51 of the spool 42, may gradually decrease as the package diameter 54 increases. There are limits on the helix angles for which winding is possible. The maximum package diameter may be constrained to some extent by the helix angle θ during winding. Further, the helix angle θ should be selected to avoid undesirable ribbons.

Single precision wind, where the ratio of the number of turns of the cake to the cycles of the traverse guide is fixed through-out the wind cycle, gives a smooth cake sidewall, but, it requires that the helix angle (angle between the cake circumference and the threadline) vary over a large range. This results varying of the yarn laydown width. A high helix angle gives a narrow laydown (narrow cake width), and a low helix gives a wider laydown. A reason for this is as the cake diameter grows, the rotation per minute decreases. The traverse (in locked ratio to the cake) thus slows down, and the helix angle drops.

Multiple-step precision winding, in addition to single precision winding or fixed wind ratio winding also can provide benefits to the yarn packages of some embodiments. Multi-step precision winding may be suitably used to wind elastomeric yarns. Multi step precision winding is a technique where the precision winding is switched through multiple stages so that the limitations on maximum package diameter (due to acceptable or suitable helix angle range) can be minimized or even eliminated.

Multi-step precision winding, where the ratio of the number of turns of the cake to the cycles of the traverse guide is adjusted (reduced) multiple times through the wind cycle, counteracts the diminishing helix angle and increasing laydown width as the cake builds diameter. For an elastomeric yarn such as spandex this results in a cake having triangular steps in the sidewall, but, the yarn laydown width overall is relatively constant. The result is a cake with straighter sidewalls that have ridges.

To obtain a satisfactory precision winding or multi-step precision winding results, selection of a wind ratio for performing the winding is an important consideration. With precision winding or multi-step precision winding, winding conditions are generally input into a controller (not shown), and the winding system automatically calculates the wind ratio.

As depicted in FIG. 9, with precision winding or multi-step precision winding the elastomeric yarn 46 is shifted by a pitch 58 of only Dy for one laydown pattern before the pattern repeats. The yarn 46 is shifted by a pitch of only Dy mm for one cycle so that an N:J ribbon is desirably avoided. The wind ratio may be expressed with the following formulas:

$$W=(N+\epsilon)/J \quad \text{(formula 1)}$$

where:

W is the wind ratio,

J is the traverse base cycle, typically in cycles per minute (cpm), as indicated by vector 50, N is the spool 42 or spindle rotation 52, typically in revolutions per minute (rpm), corresponding to traverse base cycle 50, and ϵ is the shift amount 62 of the yarn 46 in terms of rotation (°).

$$\epsilon=Dy/(\pi*D*\sin\theta) \quad \text{(formula 2)}$$

where:

Dy is the pitch 58 of the yarn 46, 46', typically in millimeters (mm), D is the package diameter 54, typically in millimeters (mm), and θ is the helix angle 56 (°).

$$W=2*St/(\pi*D*\tan\theta) \quad \text{(formula 3)}$$

where:

St is the traverse stroke in millimeters (mm), as indicated by vector 50, and D and θ are as defined above.

The spindle rotation N in formula (1) determines the helix angle θ, traverse base cycle J, the shift amount ϵ and the yarn pitch Dy due to formulas (1)-(3), and is a value which may be determined theoretically or from particular considerations for winding elastomeric yarns. The following considerations may be determined as calculation conditions, as follows:

a) Helix angle conditions b) Traverse base cycle J c) Yarn pitch Dy

With single precision winding these parameters may be obtained, as follows:

a) Helix Angle Conditions:

For helix angle conditions, it is desirable to input the maximum helix angle at winding end. Values can be input in the range where mechanical operation is possible. The helix angle upper and lower limit settings may be determined through actual winding tests by finding the helix angle range where winding is actually possible. Practical upper starting helix angles can be as high as 20 to 25 degrees or more.

b) Traverse Base Cycle J:

For fine fibers, the traverse base cycle J can set from about 20 to 100. Fewer than 20 could result in poor distribution of the fibers as each layering between the two fiber cycles offset by "Dy", since the each grouping of wraps would only have 20 spacings around the cake. More than 100 could result in clumping of adjacent fibers which are fit into 100 spaces around the cake before the next "Dy" pattern offset begins. To obtain the optimum or desirable conditions, tests using actual winding may be necessary.

c) Yarn Pitch Dy:

For spandex of 20 denier to 100 denier, a yarn pitch Dy of about 0.1 mm to about 0.4 mm is useful. An optimum value for the yarn pitch Dy may be found through actual winding tests. The optimum yarn pitch is highly dependent on the actual width of the fiber as wound in the package and is determined in testing.

With multi step precision winding these parameters may be obtained, as follows:

a) Helix Angle Conditions:

With multi step precision winding, the traverse center helix angle θ and the helix angle range [Δ-θ] may be set as helix angle conditions, where Δ is a controlled change in the helix angle, which is indicated by element 64 in FIG. 9. Winding proceeds while switching the wind ratio at the width of the helix angle range ±[Δ-θ], taking the helix angle center [θ] as the center.

When setting the helix angle center, the optimal helix angle conditions may be set according to the package form (saddle and bulge). If the helix angle range [Δ-θ] is set to a helix angle range which is smaller than necessary, it will be difficult or impossible to select the appropriate wind ratio expressed with formula (1). If the helix angle range is too large, the amount of helix angle variation between steps will be too big, and winding may be difficult due to problems like tension fluctuation and package defects. Desirably, a value of about ±0.1~0.3 may be used as a guideline for the helix angle range [Δ-θ]. The actual optimal conditions may be found through test winding.

b) Traverse Base Cycle J:

If the traverse base cycle J is too small, it may be difficult to adequately avoid ribbons or package defects.

Conversely, if this value is too large, you will approach 2:1 and 3:1 large ribbons, and it will be impossible to obtain a satisfactory package.

The optimal conditions may be found through actual winding tests. In order to keep the package surface pattern dimensions almost the same from winding start to winding end, the system may be programmed so that the traverse base cycle J varies proportionally with the package diameter. It is also possible to keep it almost fixed, regardless of package diameter. In either case, the package surface pattern gets larger in proportion to the package diameter.

c) Yarn Pitch Dy:

If the yarn pitch Dy is too small, calculation will be difficult or impossible, and traverse base cycle J ribbons may be approached. Conversely, if the value is too large, harmful ribbons over the traverse base cycle J may be approached. Optimum conditions may be found through test winding.

In addition, if desired, the precision wind method can be combined with the random wind method to result in an additional weight increase. This is done by using the random winding method in the first ~20% of the winding, allowing the helix angle to be lower than that prescribed by the precision wind method at the beginning of the wind. As stated above, the lower helix angle provides a wider yarn lay down width. When the calculated precision wind helix meets the selected random wind helix, the process is then automatically transferred to precision wind mode. The resulting random wound yarn, while less dense due to random winding, is laid down much wider, resulting in a net overall weight increase of about 10% in that layer of yarn. The helix angle in the random wind portion of the cake can be nominally constant, increasing or decreasing with the wind, as desired.

Precision wound cakes have several advantages over random wound cakes. First, larger cakes were surprisingly achieved: Internal construction of a precision wound package yields more stable package build and more uniform density throughout the package. This is due, in part, to the precision wind process wherein all fibers are uniformly spaced within the package which avoids any high compression zones and thereby makes the pressure uniform throughout the package. Since the pressure has no spikes (due to piled up yarn which occurs in random wind), the outer diameter of the precision wound cake can be larger before the pressure increases to an undesirably high amount. Lower pressure is preferred because pressure is what causes the fibers to fuse to each other (called tack). As the tack increases, the take-off tension and variability in take-off tension increase.

In unwind tests of standard cakes weighing 717 grams compared to precision wound cakes of the present invention of 755 grams, the over-end takeoff tension was lower (even though the cakes were bigger). The over-end takeoff tension was reduced from 0.81 grams to 0.74 grams. In general, the reduction in overend take-off tension can be reduced from about 5% to about 10% or more depending on the denier of the yarn and the weight of the cake. Another improvement of the inventive precision wound cakes in comparison to random wind cakes is the improvement in takeoff tension uniformity. In a 755 gram precision wound cake, the uniformity was better with standard deviation of 0.19 grams compared to 0.22 grams for the random wound cake of 717 grams.

The precision wind spandex cakes of some embodiments have many other advantages. These include the fact that the inventive spandex cakes can be unwound to the core. This is not typical with random wind cakes. By running to the core, the option to tie onto the next cake in an over-end takeoff and running continuously without machine downtime is possible. In rolling take-off, running to the core consumes all of the yarn and eliminates heel waste which can be as much as 1% or more with standard random wind cakes.

The precision wind cakes of the present invention also had greatly reduced running bands compared to standard cakes. Running bands form in rolling take-off and are caused by the roller(s) working the edges of the cake. If the yarn reversals (which make up the edge of the cake and are the curved sections of yarn between the alternating straight sections) are dislodged by this rolling action, they move away from the edge toward the center and pile up in what is called a running band. The correct ordering of yarn in sequence of unwind is lost and the next reversal to come off can be below the band. This can trap the end leading to tension plucks and broken yarn.

The precision wind cakes of the present invention also included a substantial reduction of ribbons or no ribbons within the cake compared with a standard random wind cake. The absence of ribbons avoids vibration problems due to irregular surface and also avoids trapped fibers in unwind due to this clumping of yarn in standard wind. Furthermore, All fibers were uniformly distributed resulting in a perfectly balanced cake, further minimizing vibration in winding.

Tests have shown that within the existing global standard packaging design space, a 40 denier (44 dtex) precision wind cake having 756 g and 177 mm OD can be fit. By contrast, a control cakes made by random wind were limited to 717 g (measured 178 mm OD). Part of the additional weight of the cake is due to more uniform density packaging and part is due to increased bulge (inherent in the precision wind yarn lay-down). Bulge for precision wind was 55.2-mm vs. 50.0 -mm for control.

The increase in weight of yarn is significant because when more yarn can be fit into a single box, less packaging is needed, and packaging costs are reduced. Similar results can be expected for yarn of different deniers with respect to an increase in yarn weight fitting within existing packaging. While the increase in yarn weight per package will differ depending on the yarn denier, an increase of at least about 3% or at least about 5% in the weight of the package or cake is expected.

More uniform takeoff tension and lower core pressure were also achieved with precision winding: Each threadline is incrementally indexed around the cake through the entire wind and all tack points are evenly distributed. Minimized tension plucks and potential to unwind to the core allowing for transfer tails in over end take off. Over end take off tension measurements showed that precision wind cakes of 40 denier spandex averaged 0.74 cN with a standard deviation of 0.19 cN. Control cakes of random wind 40 denier spandex measured 0.81 cN average with a standard deviation of 0.22 cN. The inventive precision wind cakes provided a reduction of greater than 8% in the over end take off tension.

Rolling take off tension measurements show that precision wind cakes averaged 0.42 CN with a standard deviation of 0.069 cN. Control cakes measured 0.46 cN with a standard deviation of 0.073 cN.

Ribbon free winding was also achieved with precision winding. Ribbons are a source of tangles in winding and unwinding and a source of package vibration in winding and unwinding. Precision wound packages are ribbon free as the reversals are sequentially deposited one next to the other, thereby providing less tangles in unwinding and fewer unwinding breaks.

Perfectly smooth sidewalls and package outer surface also results from precision winding, resulting in aesthetically appealing, perfectly balanced cakes.

Figure 10:
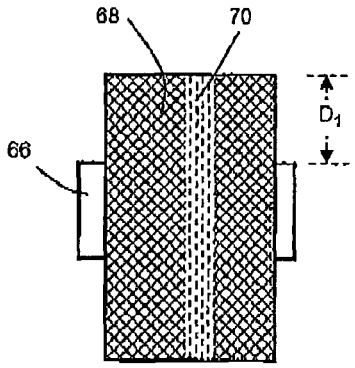
(prior art) FIG. 10
FIGS. 10 and 11 depict yarn breakage during unwinding of a yarn from a package due to yarn ribbons or fusing within the package according to the prior art.
Figure 11:
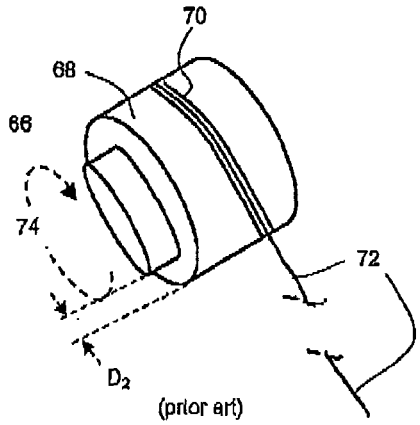
(prior art) FIG. 11

FIG. 10 depicts a yarn cake 68 wound onto a spool 66 in accordance with the winding techniques of the prior art. As depicted in FIG. 10, the yarn cake 68 has a defect, such as an internal ribbon or running band that forms 70. As depicted in FIG. 11, during unwinding, as indicated by arrow 74, when the diameter $D_2$ of the cake 68 is reduced from its initial diameter, $D_1$, the defective region 70 becomes exposed. The unwinding yarn 72 may, and often does, break as depicted in FIG. 11 when such a defective region 70 is reached during the unwinding process.

Figure 12:
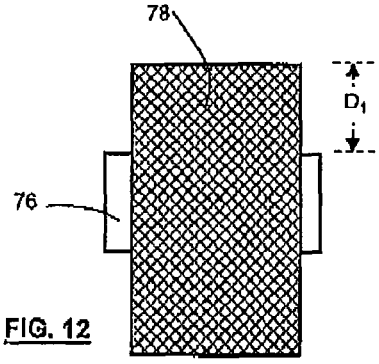
FIGS. 12-14 depict no yarn breakage during unwinding of the yarn packages of the present invention.
Figure 13:
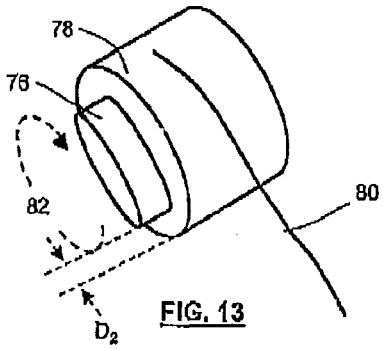
Figure 14:
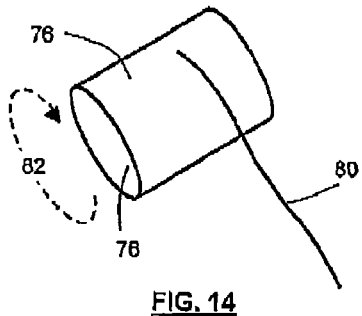

FIGS. 12-14 depict unwinding of cakes formed in accordance with the present invention. In contrast to the prior art, a yarn cake 78 wound onto a spool 76 in accordance with the winding techniques of the present invention do not have any undesirable ribbons or running bands. As depicted in FIG. 13, during unwinding, as indicated by arrow 82, the unwinding proceeds smoothly, i.e., without any disadvantages of the prior art, for example no yarn breakage, as the diameter $D_2$ of the cake 78 is reduced from its initial diameter, $D_1$. The unwinding yarn 80 shown experiences no breakage, as depicted in FIG. 13. Furthermore, as depicted in FIG. 14, the yarn 80 may be completely or substantially completely unwound from the spool 76 without breakage and without leaving any significant amount yarn on the spool 76.

EXAMPLES

An example of typical random wind and precision wind parameters is as follows:

Random Wind

Helix angle set to 12 degrees for entire winding of cake. Traverse stroke 45-mm. Package surface speed 600 meters per minute.

Precision Wind

Yarn Pitch 0.1-mm and J factor of 47. Package surface speed 600 meters per minute. Traverse stroke 45-mm. This results in an initial winding helix angle of 20 degrees and a final helix angle of 7 degrees.

Example 1

Without increasing winding tension, which is detrimental to a spandex cake due to increased fusing of yarn threadlines, higher weight spandex cakes with the same inner and outer diameters as conventional random wound cakes, were produced using precision wind. The increased weight of at least 3% or at least 5% or more, results from two effects. First, optimum selection of precision wind parameters allows the threadlines to be closely and orderly packaged increasing the uniformity of density of the cake. Second, precision wind operates to continuously decrease the winding helix angle as the cake diameter grows. This results in a continuously increasing component of threadline circumferential force, tending to increase cake compression as diameter increases. Also, the reduced helix angle results in a continuously decreasing component of threadline axial force, reducing the ability of the cake to resist bulge as the diameter increases. In addition, the continuously reducing helix angle results in a continuously increasing yarn lay down width, since a slower traverse speed provides a wider yarn lay down stroke. The net result of these three effects is a spandex cake having a large width beginning at about the first 20% of the wind, and continuing to be large through the remainder of the wind.

By comparison, a conventional spandex cake of relatively constant helix angle made by the standard random wind method will also bulge. However, at equal tension, the maximum bulge will be less, and it will be at a later stage in the winding. Also, the width of the cake will reduce as the diameter increases, with the final width substantially less than in the precision wind method. The net result is a spandex cake of less weight for equal diameter than that of a precision wound spandex cake.

In addition, if desired, the precision wind method can be combined with the random wind method to result in an additional weight increase. This is done by using the random winding method in the first ~20% of the winding, allowing the helix angle to be lower than that prescribed by the precision wind method at the beginning of the wind. As stated above, the lower helix angle provides a wider yarn lay down width. When the calculated precision wind helix meets the selected random wind helix, the process is then automatically transferred to precision wind mode. The resulting random wound yarn, while less dense due to random winding, is laid down much wider, resulting in a net overall weight increase of about 10% in that layer of yarn. The helix angle in the random wind portion of the cake can be nominally constant, increasing or decreasing with the wind, as desired.

While various embodiments of the present invention are specifically illustrated and/or described herein, it will be appreciated that modifications and variations of the present invention may be effected by those skilled in the art without departing from the spirit and intended scope of the invention. Further, any of the embodiments or aspects of the invention as described in the claims or throughout the specification may be used with one and another without limitation.

What is claimed is:

1. A method of increasing an amount of elastomeric yarn wound onto a spool, comprising:

providing a spool;

providing an elastomeric yarn;

rotating the spool at a speed to define a spool rotation speed;

moving the yarn traversely with respect to the spool in an alternating to and fro manner to define a traverse frequency;

winding the yarn onto the spool at a helix angle θ over the spool to form a yarn cake thereon, where the helix angle θ is an angle defined between a longitudinal extent of the spool and the yarn being wound onto the spool;

controlling the ratio of the spool rotation speed to the traverse frequency to define a wind ratio during the winding of the yarn onto the spool, where the wind ratio is expressed by a combination of formulas 1 and 2 or by formula 3, as follows:

$$W=(N+\epsilon)/J \quad \text{(formula 1)}$$

where:

W is the wind ratio,

J is the traverse base cycle in cycles per minute (cpm),

N is the spool rotation in revolutions per minute (rpm), and

ϵ is the shift amount of the yarn in terms of rotation;

$$\epsilon=Dy/(\pi*D*\sin\theta) \quad \text{(formula 2)}$$

where:

Dy is the pitch of the yarn in millimeters (mm),

D is the package diameter in millimeters (mm), and

θ is the helix angle (°);

$$W=2*St/(\pi*D*\tan\theta) \quad \text{(formula 3)}$$

where:

St is the traverse stroke in millimeters (mm), and

D and θ are as defined above; and decreasing the traverse speed as the yarn is wound onto the spool in an inverse proportion to an amount of yarn that has been wound.

2. The method of claim 1, wherein said elastomeric yarn is a spandex yarn.

* * * * *